United States Patent [19]

Ambal

[11] Patent Number: 4,621,393

[45] Date of Patent: Nov. 11, 1986

[54] BUTT JOINTING ASSEMBLY

[75] Inventor: Gilbert Ambal, Frepillon, France

[73] Assignee: ITW de France, Beauchamp, France

[21] Appl. No.: 780,166

[22] Filed: Sep. 26, 1985

[30] Foreign Application Priority Data

Sep. 10, 1984 [FR] France ..... 84 15472

[51] Int. Cl.[4] ..... A44B 11/10

[52] U.S. Cl. ..... 24/171; 24/194; 24/576; 24/616

[58] Field of Search ..... 24/171, 181, 194, 172, 24/182, 576, 587, 616; 403/311

[56] References Cited

U.S. PATENT DOCUMENTS

| | | | |
|---|---|---|---|
| 164,821 | 6/1875 | Eichholz | 24/576 |
| 426,401 | 4/1890 | Tehnik | 24/171 |
| 960,593 | 6/1910 | Smith | 24/171 |
| 1,429,155 | 9/1922 | Metcalf | 24/616 |
| 1,599,016 | 9/1926 | Johnson et al. | 24/616 |
| 3,313,135 | 4/1967 | Reisner | 24/616 |
| 4,143,446 | 3/1979 | Down | 24/135 R |
| 4,425,689 | 1/1984 | Fildan | 24/616 |

FOREIGN PATENT DOCUMENTS

| | | | |
|---|---|---|---|
| 1398165 | 3/1965 | France | 24/616 |
| 2451175 | 11/1980 | France | 24/616 |
| 280170 | 7/1934 | Italy | 24/616 |
| 480860 | 4/1954 | Italy | 24/587 |

*Primary Examiner*—Victor N. Sakran

*Attorney, Agent, or Firm*—J. P. O'Brien; T. W. Buckman

[57] ABSTRACT

A butt jointing assembly comprises two identical butt joint parts with the one being reversed with respect to the other. The butt joint assembly comprises an elastic locking and unlocking pawl and at least one retaining slot therein such that the pawl in the one part engages the slot in the other part, as two of such parts are butt jointed, the elastic pawl being moreover flexible through pressure of one's finger to unlock it. Application to the connection of rigid or supple elements with each element being provided with a butt joint part or being configured so as to have a butt joint part at one end thereof.

5 Claims, 2 Drawing Figures

BUTT JOINTING ASSEMBLY

This invention relates to a butt jointing assembly of the type wherein two identical parts are butt jointed, the one being reversed relative to the other; in other terms, one of the parts is given a reversed or symmetrical position with respect to the position taken by the other part.

The pair of butt jointed parts according to this invention permits to connect two rigid or supple elements, with each being provided with one of such butt jointed parts thereon (or being configured so as to form one of such parts on one end).

In the case of two supple elements butt jointed in this manner each supple element can be a strap, belt, suspender, or girdle, leather or tissue strip to begirdle, tighten or support something.

It is possible to form in this manner a double buckle of the type in which each strap has a buckle of its own.

In accordance with this invention each butt jointed part comprises an elastic locking and unlocking pawl and at least one retaining slot therein such that the pawl of one part is made fast in the slot of the other part as two of such parts are butt jointed (while one of them is reversed with respect to the other), the elastic pawl being moreover flexible through the pressure of one's finger to obtain unlocking thereof.

The pawl is intrinsically elastic and made integrally with the remainder of the part.

According to an alternative form of embodiment each butt jointed part is formed with several retaining slots therein such as those formed in a rack.

The slot is formed in a plate of the butt jointed part to receive a projection of the elastic pawl of the other part and maintain it in the locking position.

The slot, due to its configuration, closes on itself and presents an access ramp which is met by the projection of the other part upon abutting thereof.

At least one rectilinear sharp rise extends alongside the plate such that the sharp rise and plate configuration of one part constitutes sliding means for the other part abutting thereto.

A stop for the end of the abutment path is provided on the part.

Centering means can also be provided on the part.

Other characteristics and advantages of this invention will appear from the following description which is made with reference to the attached drawings in which.

Figure 1:
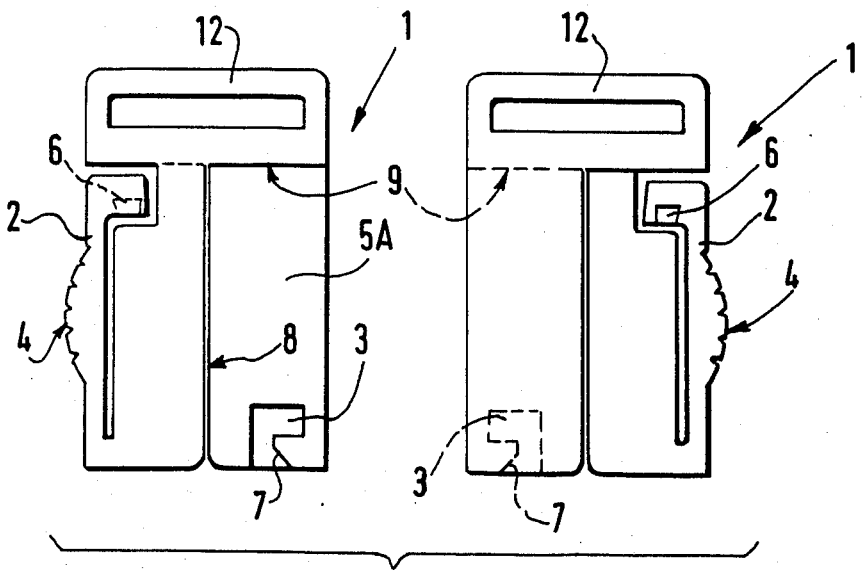
FIG. 1 is a plane view of two identical parts according to the invention, with one being however reversed relative to the other.
Figure 2:
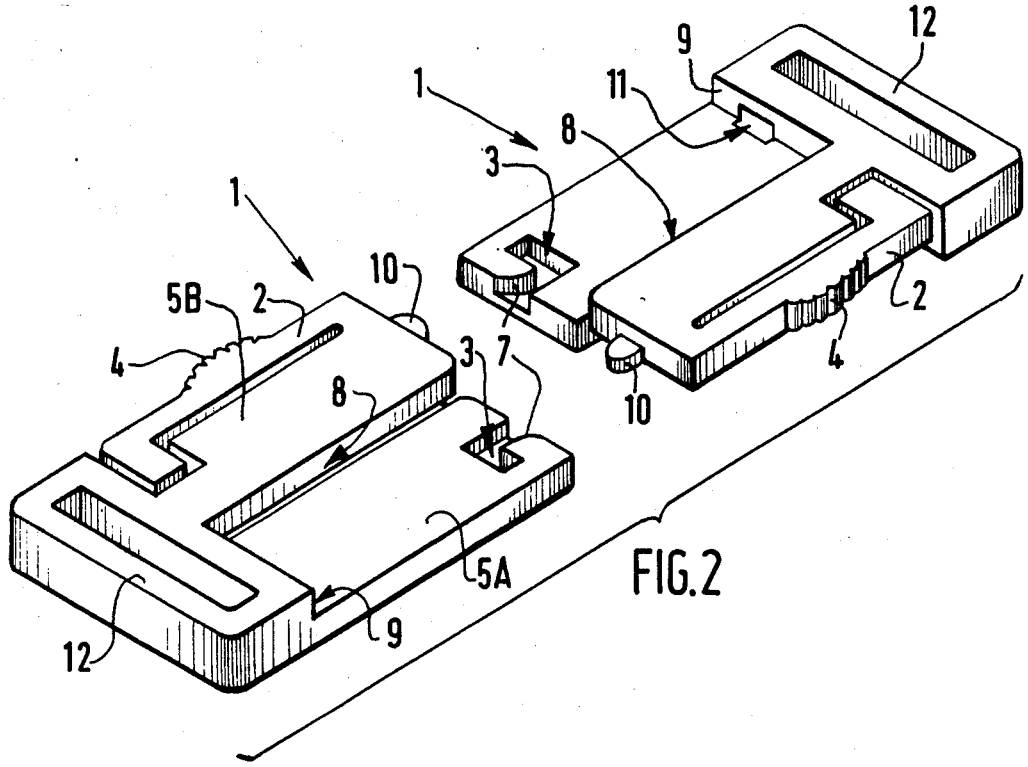
FIG. 2 is a perspective view of these two same parts facing each other.

In the form of embodiment shown merely by way of example a butt joint part 1 according to the invention comprises an elastic locking and unlocking pawl 2 made integrally with the remainder of the part (which is preferably made of a thermoplastic material) and at least one retaining slot 3.

The pawl 2 carries outwardly a knurled boss 4 or any other suitable shape or relief therein to receive pressure from a finger of the user's hand for the unlocking thereof.

The retaining slot 3 is formed in a plate 5A of the part to receive a projection 6 of the elastic pawl 2 of the other identical butt joint part disposed opposite thereto and reversed by 180°.

The slot 3, due to its configuration, closes on itself and presents a ramp 7 thereon to be followed by the projection of the pawl of the other part.

A rectilinear sharp rise 8 extends along the plate 5A in which the retaining slot 3 is formed and is used as sliding means for the other butt joint part to prevent any lateral and transverse motions.

A stop 9 for the end of the abutment path is provided on part 1.

Centering means formed by complementary centering lug 10 and centering hole 11 can be provided on part 1.

In the form of embodiment shown the part 1 comprises a second plate 5B offset with respect to the plate 5A, the second plate 5B carrying the elastic pawl 2, and the offsetting of the plate forming a sharp rise 8 on each face of the part. According to such arrangement, the plate 5B of one of the butt jointed parts will be superposed on the plate 5A of the other part.

In this form of embodiment the centering lug 10 of the centering means is carried by the plate 5B and the centering hole 11 is formed in the stop 9. Of course, one can contemplate a reversed arrangement.

By way of example, the butt jointed part carries a flat ring 12 to receive a strap therein such that the assembly of both parts to be butt jointed constitutes a double buckle.

Finally, according to an alternative form of embodiment, each butt jointed part is formed with several retaining slots 3 as shown for example in a rack.

It will be understood that this invention was only described and represented by way of a preferential form of embodiment and that equivalent parts can be substituted for its constituents without however departing from the scope of the invention as required by the appended claims.

I claim:

1. A butt-jointing buckle assembly of two identical buckle parts, each buckle part comprising a strap receiving base member and two plate members integrally formed at their inner end with said base end extending side-by-side in an offset relationship and in a generally parallel direction from said base, said plate members being longitudinally disposed from said base on opposite sides of the longitudinal axis, one of said plate members including an elastic pawl integrally connected at its outer end in a flexible manner with its free end extending toward said inner end of said one plate member, said free end of said elastic pawl having a projection crossing an imaginary plane defined by said other plate member, a retaining slot formed inwardly of the outer end of said other plate member and a ramp surface formed at the outer end of said retaining slot, said slot and said projection being located in opposite facing surfaces of said two plate members and being laterally spaced an equal distance from said longitudinal axis so that the projection on an identical buckle part is adapted to engage said ramp surface and force the free end of the elastic pawl to move laterally inward as the two buckle parts are brought together and thereafter be retained in said retaining slot.

2. A butt-jointing buckle assembly as defined in claim 1, further comprising a rectilinear sharp rise along the adjacent lateral edges of said two plate members to provide a sliding guide surface for the identical buckle part.

3. A butt-jointing buckle assembly as defined in claim 1, further comprising a centering lug extending forwardly of said outer end of each of said two plate members and a conforming centering opening formed in said inner end of each of said two plate members in direct longitudinal alignment with each of said centering lugs.

4. A butt-jointing buckle assembly of two identical buckle parts, each buckle part comprising a strap receiving base member and two generally rectangular-shaped plate members integrally formed at their inner end with said base end extending side-by-side in an offset relationship in a general parallel direction, said plate member being longitudinally disposed to define a rectilinear sharp rise along their adjacent lateral edges, one of said plate members including an elastic pawl integrally connected at its outer end in a flexible manner with its free end extending toward said inner end of said one plate member, said free end of said elastic pawl having a projection crossing an imaginary plane defined by said other plate member, a retaining slot formed inwardly of the outer end of said other plate member, and a ramp surface formed at the outer end of said retaining slot, said slot and said projection being formed in opposite faceing surfaces of said two plate members and being laterally located across the width of said two plate members so that the projection on the pawl of an identical buckle part is adapted to engage said ramp surface and force the free end of the elastic pawl to move laterally inward as the two buckle parts are brought together and thereafter be retained in said retaining slot.

5. A butt-jointing buckle assembly as defined in claim 4, further comprising a centering lug extending forwardly of said outer end of each of said two plate members and a conforming centering opening formed in said inner end of each of said two plate members in direct longitudinal alignment with each of said centering lugs.

* * * * *